US010349159B2

(12) United States Patent
Pruitt

(10) Patent No.: US 10,349,159 B2
(45) Date of Patent: Jul. 9, 2019

(54) HEADSET MOUNTABLE MICROPHONE SHIELD

(71) Applicant: Alex Pruitt, Bessemer, AL (US)

(72) Inventor: Alex Pruitt, Bessemer, AL (US)

( * ) Notice: Subject to any disclaimer, the term of this patent is extended or adjusted under 35 U.S.C. 154(b) by 0 days.

(21) Appl. No.: 15/807,760

(22) Filed: Nov. 9, 2017

(65) Prior Publication Data

US 2019/0141427 A1 May 9, 2019

(51) Int. Cl.
*H04R 1/08* (2006.01)
*H04R 1/10* (2006.01)

(52) U.S. Cl.
CPC ..... *H04R 1/086* (2013.01); *H04R 1/1091* (2013.01); *H04R 1/1016* (2013.01); *H04R 1/1058* (2013.01); *H04R 2201/103* (2013.01); *H04R 2205/024* (2013.01); *H04R 2420/07* (2013.01)

(58) Field of Classification Search
CPC ..... H04R 1/1091; H04R 1/1008; H04R 1/08; H04R 9/08; H04R 1/086; H04R 2201/107; H04R 1/1083
See application file for complete search history.

(56) References Cited

U.S. PATENT DOCUMENTS 4,491,699 A * 1/1985 Walker ..... H04M 1/05 128/201.19
8,434,493 B1 * 5/2013 McGhie ..... A41D 13/1161 128/200.24
9,241,208 B2 * 1/2016 Ball ..... H04R 1/086
2008/0089546 A1 * 4/2008 Ward ..... H04R 1/083 381/376
2008/0134402 A1 * 6/2008 Bailey ..... A63B 71/10 2/9
2008/0304690 A1 * 12/2008 Poindexter ..... H04R 1/08 381/375
2010/0034412 A1 * 2/2010 Parda ..... H04R 1/086 381/355
2012/0029912 A1 * 2/2012 Almagro ..... G10K 11/178 704/226
2012/0272484 A1 * 11/2012 Willborn ..... A61F 9/025 24/3.11
2015/0373447 A1 * 12/2015 Ball ..... H04R 1/086 381/359

* cited by examiner

*Primary Examiner* — Oyesola C Ojo
(74) *Attorney, Agent, or Firm* — Jerry D Haynes; Law Office of Jerry D Haynes PA

(57) ABSTRACT

A headset mountable microphone shield for obscuring the lips of a wearer of a conventional headset with hands free microphone. The headset mountable microphone shield includes a shield body which defines a planar member sized to obscure the mouth of a person and which is integrated with a clip member which defines an elongated limb with a front side and a back side. The clip member is attachable to a stem which connects a hands free microphone to a conventional headset through a pair of clips on its back side and secured in place with fastening screws which operate in conjunction with the clips. As such, a user can slide the stem into the clips and tighten the fastening screws, thereby wedging the stem against the clip such that it is held in place.

10 Claims, 2 Drawing Sheets

HEADSET MOUNTABLE MICROPHONE SHIELD

BACKGROUND OF THE INVENTION

Field of the Invention

This invention relates generally to mouth shielding devices and, more particularly, to a headset attachable microphone shielding apparatus for obscuring the mouth of a user of a microphone.

Description of the Prior Art

The use of hands free microphones, typically mounted on a stem which extends from a headset to an area in front a wearer's mount, by football coaches and other sports participants/administrators is well known. A problem which still exists, however, is that it is common for opposing coaches or players, or those working with the opposing team, to attempt to intercept communications which are spoken into such a conventional hands free microphone by reading the speaker's lips. To combat this problem, football coaches or other speakers commonly hold a board or sheet, such as a play sheet, up to their mouth when speaking into the microphone to obscure their mouth. Such a manual system, however, is not always effective because not only does it result in the speaker showcasing that fact he is about to speak before he does it, the speaker may not always fully cover his mouth. Thus, there remains a need for a headset mountable microphone shield which would eliminate the need for a user of a hands free microphone to manually cover their mouth each time they were going to speak into the microphone. It would be helpful if such a headset mountable microphone shield clipped directly on the stem which connects the microphone to a headset. It would be additionally desirable for such a headset mountable microphone shield to employ an attachment system which enabled it to be selectively fixed in place once clipped on the stem.

The Applicant's invention described herein provides for a headset mountable microphone shield adapted to attach to the stem which connects a hands free microphone to a headset. The primary components in Applicant's headset mountable microphone shield are a shield body, a clip member, and a fastening screw. When in operation, the headset mountable microphone shield enables a speaker to have their mouth completely shielded at all times while speaking into a hands free microphone. As a result, many of the limitations imposed by prior art structures are removed.

SUMMARY OF THE INVENTION

A headset mountable microphone shield for obscuring the lips of a wearer of a conventional headset with hands free microphone. The headset mountable microphone shield includes a shield body which defines a planar member sized to obscure the mouth of a person and which is integrated with a clip member which defines an elongated limb with a front side and a back side. The clip member is attachable to a stem which connects a hands free microphone to a conventional headset through a pair of clips on its back side and secured in place with fastening screws which operate in conjunction with the clips. As such, a user can slide the stem into the clips and tighten the fastening screws, thereby wedging the stem against the clip such that it is held in place and will not slide or rotate.

It is an object of this invention to provide a headset mountable microphone shield which eliminates the need for a user of a hands free microphone to manually cover their mouth each time they were going to speak into the microphone.

It is another object of this invention to provide a headset mountable microphone shield that clips directly on the stem which connects the microphone to a headset.

It is yet another object of this invention to provide a headset mountable microphone shield that employs an attachment system defined by a clip and fastening screw which enables it to be selectively fixed in place once clipped on the stem.

These and other objects will be apparent to one of skill in the art.

DETAILED DESCRIPTION OF THE INVENTION

Figure 1:
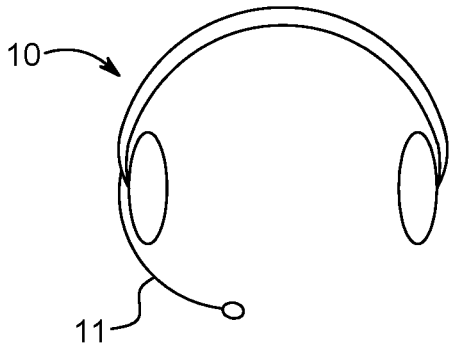
Prior Art FIG. 1
FIG. 1 is a front elevational view of a conventional headset with hands free microphone.
Figure 2:
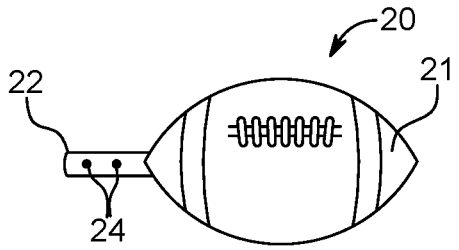
FIG. 2 is a front elevational view of a headset mountable microphone shield built in accordance with the present invention.

Referring now to the drawings and in particular FIGS. 1, 2, 3*a*, 3*b*, and 4, a headset mountable microphone shield 20 is shown as a shield body 21 integrated with a clip member 22. The shield body 21 defines a planar member sized such that when it is placed in front of the mouth of a person, it fully shields the lips of the mouth, whether open or closed, from substantially any angle from which the movement of the lips could be deciphered into language or otherwise read. In the preferred embodiment, the shield body 21 measures at least six (6) inches wide and four (4) inches tall.

Connected to one end of the shield body 21 is the clip member 22. The clip member 22 defines an elongated limb with a front side and a back side and which extends from the shield body 21. The clip member 22 is attachable to a stem 11 which connects a hands free microphone to a conventional headset 10. In the illustrated embodiment, the clip member 22 defines a straight planar limb.

Figure 3A:
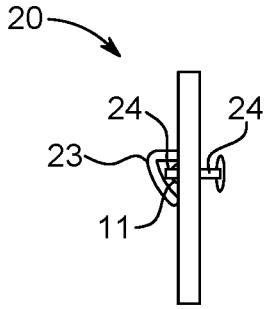
FIG. 3*a* is a side elevational view of a headset mountable microphone shield built in accordance with the present invention with a fastening screw in a secured position.

The back side of the clip member 22 includes two biased clips 23 into which the stem 11 can be slid. A fastening screw 24 is employed with each clip 23 to the stem 11 in place inside the clip 23. The screw 24 can be engaged so that it passes through the clip member 22, and as it passes through the clip member 22, it moves closer and closer to the clip 23. In this manner, the stem 11 which has been slid into the clip 23 can be wedged against the clip 23 by the fastening screw 24, as illustrated in FIG. 3*a*.

Figure 3B:
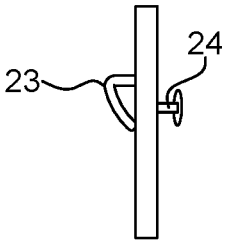
FIG. 3*b* is a side elevational view of a headset mountable microphone shield built in accordance with the present invention with a fastening screw in an open position.
Figure 4:
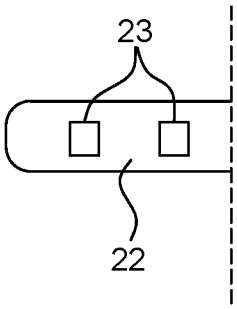
FIG. 4 is a partial back elevational view of a clip of a headset mountable microphone shield built in accordance with the present invention.

When it is desired to remove the stem 11, the fastening screw 24 is loosened so that it receeds back into and through the clip member 22, as illustrated in FIG. 3*b*, and the stem 11 can be slid down out of the clips 23.

Figure 5:
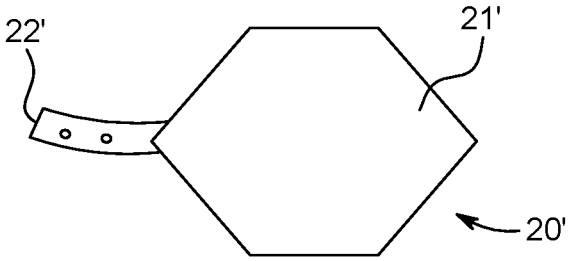
FIG. 5 is a front elevational view of a headset mountable microphone shield built in accordance with an alternate embodiment of the present invention.

Referring now to FIG. 5, in an alternate embodiment of the headset mountable microphone shield 20', the shield body 21' defines an alternate shape and the clip member 22' is curved such that it contours to the shape of conventional headset microphone stems.

The instant invention has been shown and described herein in what is considered to be the most practical and preferred embodiment. It is recognized, however, that departures may be made therefrom within the scope of the invention and that obvious modifications will occur to a person skilled in the art.

The invention claimed is:

1. A headset mountable microphone shield, comprising:

a shield body defining a planar member sized to shield a mouth of a person when positioned in front thereof;

a clip member integral with said shield body and adapted to attach to a stem which connects a hands free microphone to a conventional headset, wherein said clip member defines an elongated limb which extends from the shield body;

at least one clip integral with said clip member and configured to enable the stem to engagably slide therein; and an elongated fastener associated with each of the at least one clips, wherein each of said elongated fasteners is configured to selectively wedge the stem slidably engaged in the fastener's respective clip against the clip, thereby fixing the stem in place in the clip and said elongated fastener includes a first position that engages the stem and a second position that disengages the stem for removal of the stem.

2. The headset mountable microphone shield of claim 1, wherein said clip member and said shield body are oriented on a single plane.

3. The headset mountable microphone shield of claim 1, wherein said clip member defines a straight planar limb.

4. The headset mountable microphone shield of claim 1, wherein said clip member defines a curved limb.

5. The headset mountable microphone shield of claim 1, wherein said clip member includes two clips.

6. A headset mountable microphone shield, comprising:

a shield body defining a planar member sized to shield a mouth of a person when positioned in front thereof;

a clip member integral with said shield body and adapted to attach to a stem which connects a hands free microphone to a conventional headset;

a plurality of clips integral with said clip member and configured to enable the stem to engagably slide therein; and an elongated fastener associated with each of the at least one clips, wherein each of said elongated fasteners is configured to selectively wedge a stem slidably engaged in the fastener's respective clip against the clip, thereby fixing the stem in place in the clip, and said elongated fastener includes a first position that engages the stem and a second position that disengages the stem for removal of the stem.

7. The headset mountable microphone shield of claim 6, wherein said clip member defines an elongated limb which extends from the shield body.

8. The headset mountable microphone shield of claim 7, wherein said clip member and said shield body are oriented on a single plane.

9. The headset mountable microphone shield of claim 7, wherein said clip member defines a straight planar limb.

10. The headset mountable microphone shield of claim 7, wherein said clip member defines a curved limb.

* * * * *